US011466523B2

(12) United States Patent
Singh et al.

(10) Patent No.: US 11,466,523 B2
(45) Date of Patent: Oct. 11, 2022

(54) MANAGING EQUIVALENT CIRCULATING DENSITY DURING A WELLBORE OPERATION

(71) Applicant: Halliburton Energy Services, Inc., Houston, TX (US)

(72) Inventors: John Paul Bir Singh, Kingwood, TX (US); Sandeep D. Kulkarni, Kingwood, TX (US); Vitor Lopes Pereira, The Woodlands, TX (US); Krishna Babu Yerubandi, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 279 days.

(21) Appl. No.: 16/078,623

(22) PCT Filed: May 20, 2016

(86) PCT No.: PCT/US2016/033470

§ 371 (c)(1),
(2) Date: Aug. 21, 2018

(87) PCT Pub. No.: WO2017/200548

PCT Pub. Date: Nov. 23, 2017

(65) Prior Publication Data

US 2019/0048672 A1 Feb. 14, 2019

(51) Int. Cl.
*E21B 21/08* (2006.01)
*E21B 19/00* (2006.01)
(Continued)

(52) U.S. Cl.
CPC ..... *E21B 21/08* (2013.01); *E21B 19/00* (2013.01); *E21B 33/14* (2013.01); *E21B 47/06* (2013.01)

(58) Field of Classification Search
CPC ..... E21B 21/08; E21B 19/00; E21B 33/14; E21B 47/06
See application file for complete search history.

(56) References Cited

U.S. PATENT DOCUMENTS 8,024,962 B2 9/2011 Tonmukayakul et al.
8,424,368 B2 4/2013 Tonmukayakul et al.
(Continued)

FOREIGN PATENT DOCUMENTS

WO 2015175784 A1 11/2015

OTHER PUBLICATIONS

Wereley, Steven T., Alp Akonur, and Richard M. Lueptow. "Particle-fluid velocities and fouling in rotating filtration of a suspension." Journal of membrane science 209.2 (2002): 469-484.*
(Continued)

*Primary Examiner* — Bijan Mapar
(74) *Attorney, Agent, or Firm* — Delizio, Peacock, Lewin & Guerra

(57) ABSTRACT

The equivalent circulating density ("ECD") in a wellbore may be managed during a wellbore operation using ECD models that take into account the rheology of the wellbore fluid and the rotational speed of tubulars in the wellbore. For example, a method may include rotating a rotating tubular in a stationary conduit while flowing a fluid through an annulus between the rotating tubular and the stationary conduit; calculating an equivalent circulating density ("ECD") of the fluid where a calculated viscosity of the fluid is based on an ECD model ?_eff=f(? ?_eff)*h(Re), wherein ?_eff is the viscosity of the fluid, ? ?_eff is an effective shear rate of the fluid, and Re is a Reynold's number for the fluid for the rotational speed of the rotating tubular; and changing an operational parameter of the wellbore operation to maintain or change the ECD of the fluid.

20 Claims, 4 Drawing Sheets

(51) Int. Cl.
*E21B 33/14* (2006.01)
*E21B 47/06* (2012.01)

(56) References Cited

U.S. PATENT DOCUMENTS

| | | | | |
|---|---|---|---|---|
| 8,794,051 | B2 | 8/2014 | Morgan et al. | |
| 2003/0146001 | A1* | 8/2003 | Hosie | E21B 4/02 166/369 |
| 2007/0068705 | A1* | 3/2007 | Hosie | E21B 21/00 175/57 |
| 2012/0094876 | A1 | 4/2012 | Jamison et al. | |
| 2012/0118638 | A1 | 5/2012 | Orbell et al. | |
| 2014/0131101 | A1 | 5/2014 | Coley et al. | |
| 2015/0330213 | A1* | 11/2015 | van Oort | E21B 47/06 73/152.31 |

OTHER PUBLICATIONS

International Search Report and Written Opinion from PCT/US2016/033470, dated Mar. 16, 2017, 18 pages.
GB Application No. GB2103128.1, Search Report dated Jun. 25, 2021, 4 pages.

* cited by examiner

MANAGING EQUIVALENT CIRCULATING DENSITY DURING A WELLBORE OPERATION

BACKGROUND

The present application relates to managing the equivalent circulating density during a wellbore operation.

When flowing fluids through a wellbore, the fluids exert a pressure on the formation that should be carefully managed to mitigate damage to the surrounding formation and prevent formation fluids from leaking into the wellbore. The "equivalent circulating density" or "ECD" of a fluid refers to effective density exerted by the fluid against the formation taking into account the annular pressure drop. Managing the ECD of the fluid between the fracture gradient and pore-pressure gradient of a formation during a wellbore operation may increase the efficacy and efficiency of the wellbore operation. More specifically, keeping the ECD of the wellbore fluid below the fracture gradient of the formation (i.e., the pressure at which fractures are induced in the formation) mitigates loss of the fluid into the surrounding formation. Leak-off of fluid to the formation leads requires increased volumes of the fluid to perform an effective wellbore operation, which can significantly increase the cost of the wellbore operation. Additionally, keeping the ECD of the wellbore fluid above the pore-pressure gradient (i.e., the pressure at which the fluids from the formation infiltrate the wellbore) mitigates dilution and mixing of formation fluids and the fluid. In some instances, dilution of the fluid may reduce the efficacy of the fluid. Further, in some instances, formation fluids or components thereof (e.g., salts) may deactivate components of the fluid, thereby rendering the wellbore operation ineffective.

BRIEF DESCRIPTION OF THE DRAWINGS

The following figures are included to illustrate certain aspects of the embodiments, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

The present application relates to managing the ECD during a wellbore operation using ECD models that take into account the rheology of the wellbore fluid and the rotational speed of tubulars in the wellbore.

Unless otherwise specified, use of the term "wellbore fluid" shall be construed as encompassing all fluids originating from within the wellbore and all fluids introduced or intended to be introduced into the wellbore. Accordingly, the term "wellbore fluid" encompasses, but is not limited to, formation fluids, production fluids, wellbore servicing fluids, the like, and any combinations thereof.

Figure 1:
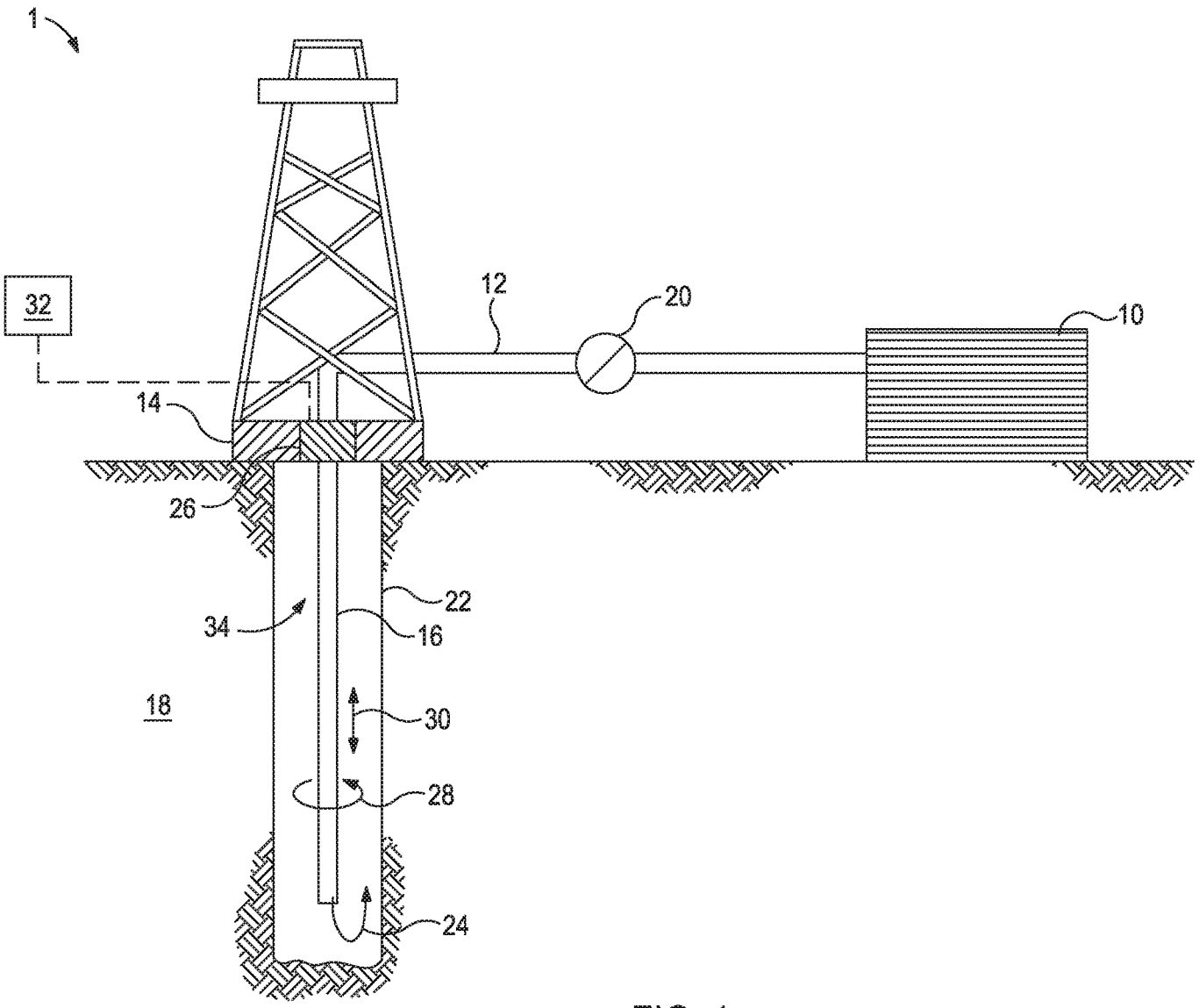
FIG. 1 illustrates an exemplary schematic of a system that can deliver wellbore fluids to a downhole location.

FIG. 1 illustrates an exemplary schematic of a system 1 that can deliver wellbore fluids to a downhole location, according to one or more embodiments. It should be noted that while FIG. 1 generally depicts a land-based system, it is to be recognized that like systems may be operated in subsea locations as well. As depicted in FIG. 1, system 1 may include mixing tank 10, in which a wellbore fluid may be formulated. Again, in some embodiments, the mixing tank 10 may represent or otherwise be replaced with a transport vehicle or shipping container configured to deliver or otherwise convey the wellbore fluid to the well site. The wellbore fluid may be conveyed via line 12 to wellhead 14, where the wellbore fluid enters tubular 16 (e.g., a casing, drill pipe, production tubing, coiled tubing, etc.), tubular 16 extending from wellhead 14 into wellbore 22 penetrating subterranean formation 18. Upon being ejected from tubular 16, the wellbore fluid may subsequently return up the wellbore in the annulus between the tubular 16 and the wellbore 22 as indicated by flow lines 24. In other embodiments, the wellbore fluid may be reverse pumped down through the annulus and up tubular 16 back to the surface, without departing from the scope of the disclosure. Pump 20 may be configured to raise the pressure of the wellbore fluid to a desired degree before its introduction into the tubular 16 (or annulus).

The system 1 may further include a motor 26 to rotate the tubular 16 according to arrows 28. The motor 26 may be communicably coupled to a processor 32 that monitors and controls the rotational speed of the tubular 16. In some instances, an ECD model described further herein may be implemented using the processor 32 or another processor (not illustrated) communicably coupled to the processor 32.

It is to be recognized that system 1 is merely exemplary in nature and various additional components may be present that have not necessarily been depicted in FIG. 1 in the interest of clarity. Non-limiting additional components that may be present include, but are not limited to, supply hoppers, valves, condensers, adapters, joints, gauges, sensors, compressors, pressure controllers, pressure sensors, flow rate controllers, flow rate sensors, temperature sensors, and the like.

One skilled in the art, with the benefit of this disclosure, should recognize the changes to the system described in FIG. 1 to provide for specific wellbore operations (e.g., fracturing operations, acidizing operations, primary cementing operations, secondary cementing operations, squeeze cementing operations, completion operations, and the like).

For example, when using the system 1 of FIG. 1 for a cementing operation, the wellbore fluid (e.g., a cement slurry, a displacement fluid, or a spacer fluid) is placed in the annulus 34 between the wellbore 22 and the tubular 16. Alternatively, the wellbore 22 may already be lined with a casing, and the annulus 34 is defined between the casing and the tubular 16. Generally, for the methods described herein, two concentric conduits are considered where the outer conduit is stationary, the inner conduit rotates, and the wellbore fluid flows axially in the annulus between the outer conduit and the inner conduit. Accordingly, the term "stationary conduit" is used herein to refer to the outer barrier of the annulus 34, and the term "rotating tubular" is used here to refer to the inner barrier of the annulus 34.

During the wellbore operation, the rotational speed of the rotating tubular may affect the ECD of the wellbore fluid. Further, the rheology of the wellbore fluid (e.g., shear-dependent viscosity, yield stress, or both) may be tailored such that increasing the rotational speed of the rotating tubular may increase or decrease the ECD of the wellbore fluid.

When the rotating tubular is rotated, the ECD of the wellbore fluid may be affected by two competing physics: shear thinning and Taylor instability (or Taylor-Couette instability, referred to herein collectively as or "Taylor instability").

When the rotating tubular is not rotating, the axial shear rate of the fluid in the wellbore may be based on the wellbore fluid being considered a Power-law fluid, a Bingham plastic fluid, a Herschel-Bulkley fluid, a generalized Herschel-Bulkley fluid, a Casson fluid, or any such generalized Newtonian fluid.

The viscosity ($\mu$) of the wellbore fluid can be calculated as a function ($f$) of shear rate ($\dot{\gamma}$) as illustrated in Equation 1 below. The rheological data from a viscometer/rheometer (e.g., a Fann®-35, Fann-50, Fann-75, or Fann-77 viscometer/rheometer) may be obtained in terms of shear stress or viscosity at desired conditions of shear rate ($\gamma$), temperature (T) and pressure (P). Considering the shear-thinning characteristic of the wellbore fluids, pseudoplastic models including power-law model, Eyring model, Cross model, Carrau model, Ellis model, and the like may be applied to the rheology data to extract the characteristic parameters. In addition, the rheology data may also be modeled considering the existence of yield stress (or apparent yield stress) (e.g., using viscoplastic models). Different viscoplastic models may include Bingham-plastic model, Casson model, Herschel-Bulkley model, and the like. The rheological properties of the fluid, which may be based on the rheological data or the characteristics parameters obtained by applying one or more of above pseudo-plastic/viscoplastic models, are used to determine function $f$.

$$\mu=f(\dot{\gamma}) \qquad \text{Equation 1}$$

When the rotating tubular is rotating, the shear rate becomes an effective shear rate ($\dot{\gamma}_{eff}$) that includes the axial contribution ($\dot{\gamma}_{axial}$) and rotational contribution ($\dot{\gamma}_{rot}$) to the shear rate as illustrated in Equation 2. The axial contribution to the shear rate is from flow in the axial direction as indicated by arrow 30 in FIG. 1, and the rotational contribution is from flow in the rotational direction indicated by arrow 28 in FIG. 1.

$$\dot{\gamma}_{eff}=\sqrt{\dot{\gamma}_{axial}^2+\dot{\gamma}_{rot}^2} \qquad \text{Equation 2}$$

Based solely on Equations 1 and 2 (i.e., $\mu_{eff}=f(\dot{\gamma}_{eff})$), one would expect an increase in rotational speed to increase the $\dot{\gamma}_{rot}$, which would decrease the viscosity of the shear-thinning fluid and decrease the ECD in the wellbore. However, the present ECD model also accounts for the Taylor instability, which is a secondary flow that occurs in the annular gap between two coaxial cylinders (eccentric or concentric) of differing diameter when the inner cylinder rotates faster than a critical value below which rotary Couette flow occurs. Above the critical value for rotation of the inner cylinder, pairs of counter-rotating axisymmetric (toroidal) vortices are formed in the radial and axial directions while the principal flow continues to be around the azimuth, which increases the wall shear stress (torque), increases the rate of heat transfer, and increases the rate of mixing within the fluid. By accounting for the Taylor instability in the ECD models of the present disclosure, an increase in the rotational speed may increase the ECD of the wellbore fluid.

The additional energy dissipation from the Taylor instability may be captured mathematically by using appropriate function of Reynolds number where the energy dissipation is increasing function of Reynolds number (Re). The function (h) may be a power function, an exponential function, a polynomial function, a linear function, and the like, and a combination of the foregoing functions. Incorporation of the function (h) of the Reynolds number (Re) to account for Taylor instability is illustrated in Equation 3.

$$\mu_{eff}=f(\dot{\gamma}_{eff})*h(Re) \qquad \text{Equation 3}$$

By way of nonlimiting example, h(Re) may be expressed mathematically according to Equation 4, where Re is the Reynold's number of the wellbore fluid at the operating rotational speed of the rotating tubular, $Re_{crit}$ is the Reynold's number at the critical value for rotation of the rotating tubular, and $\alpha$ and $\beta$ are factors determined experimentally.

$$h(Re)=\left[1+\alpha\left[\left(\frac{Re}{Re_{crit}}\right)^{\beta}-1\right]\right] \qquad \text{Equation 4}$$

Because Taylor instability occurs when $Re \geq Re_{crit}$, the ECD models of the present disclosure may be generally described by Equations 5, where the contribution of the Taylor instability is applied when $Re \geq Re_{crit}$ $$\mu_{eff}=f(\dot{\gamma}_{eff}) \text{ when } Re<Re_{crit} \qquad \text{Equations 5}$$

$$\mu_{eff}=f(\dot{\gamma}_{eff})\left[1+\alpha\left[\left(\frac{Re}{Re_{crit}}\right)^{\beta}-1\right]\right] \text{ when } Re \geq Re_{crit}$$

Based on the rheological properties of the fluid, which may be based on the rheological data or the characteristics parameters obtained by applying one or more pseudo-plastic/viscoplastic models, the annular frictional pressure losses may be calculated. The annular frictional pressure loss may then be used to estimate equivalent circulating density (ECD). Estimating the ECD based on the annular frictional pressure loss may be performed according to several methods and calculations known to a person of ordinary skill in the art. By way of nonlimiting example, American Petroleum Institute Recommended Practice (API-RP) 13D:2010 describes one such method.

The ECD models of the present disclosure may be used when planning a wellbore operation (e.g., fracturing operations, acidizing operations, primary cementing operations, secondary cementing operations, squeeze cementing operations, completion operations, and the like). For example, the wellbore operation may be modeled several times with different wellbore fluid formulations/compositions (e.g., having different fluid rheologies) with a computer program that uses an ECD model of the present disclosure to determine a formulation and wellbore operation parameters that maintain the ECD between the fracture gradient and pore-pressure gradient of a formation. Alternatively or in combination with modeling different wellbore fluid formulations/compositions, different wellbore operation parameters (e.g., the rotational speed of the rotating tubular, the axial flow rate of the wellbore fluid through the annulus between the rotating tubular and the stationary conduit, a yield stress of the wellbore fluid, a shear-dependent viscosity of the wellbore fluid, a formulation of the wellbore fluid, and any combination thereof) may be modeled with the computer program implementing an ECD model of the present disclosure.

In some instances, after planning, the wellbore operation may be implemented in the field where the wellbore fluid rheology, the wellbore operation parameters (e.g., the rotational speed of the rotating tubular, the axial flow rate of the wellbore fluid through the annulus between the rotating tubular and the stationary conduit, a yield stress of the wellbore fluid, a shear-dependent viscosity of the wellbore fluid, a formulation of the wellbore fluid, and any combination thereof), or both are adjusted during the wellbore operation to maintain the ECD between the fracture gradient and pore-pressure gradient of the formation. In some instances, the ECD models may optionally be used during implementation of the wellbore operation.

The ECD models of the present disclosure may be used in the field for making adjustments to (1) the wellbore fluid rheology, (2) the wellbore operation parameters (e.g., the rotational speed of the rotating tubular, the axial flow rate of the wellbore fluid through the annulus between the rotating tubular and the stationary conduit, a yield stress of the wellbore fluid, a shear-dependent viscosity of the wellbore fluid, a formulation of the wellbore fluid, and any combination thereof), or (3) both so as to maintain or return the ECD between the fracture gradient and pore-pressure gradient of a formation. For example, if unexpected fluid loss of the wellbore fluid is occurring, the ECD may be too high such that the formation is fracturing. Alternatively, downhole sensors may indicate that formation fluids are infiltrating the wellbore fluid because the ECD is too low. In both instances, the wellbore fluid rheology, the wellbore operation parameters (e.g., the rotational speed of the rotating tubular, the axial flow rate of the wellbore fluid through the annulus between the rotating tubular and the stationary conduit, a yield stress of the wellbore fluid, a shear-dependent viscosity of the wellbore fluid, a formulation of the wellbore fluid, and any combination thereof), or both may be adjusted to return the ECD between the fracture gradient and pore-pressure gradient of a formation.

By way of nonlimiting example, the wellbore operation may involve placing a cement slurry in the annulus, where the ECD of the cement slurry during placement may be managed using the ECD model described herein.

By way of another nonlimiting example, the wellbore operation may involve running a tubular into the wellbore and the ECD model may be applied to surge and swab calculations to more accurately calculate the wellbore pressures. Then, rotation of the tubular may be used to adjust the ECD of the downhole while running the tubular into the wellbore.

By way of yet another nonlimiting example, the ECD models of the present disclosure may be used when performing wellbore operations that remove filter cake from the wellbore surface. More specifically, an ECD model may be implemented in combination with filter cake removal calculations to account for the disrupting effect of rotating a tubular inside the wellbore on the filter cake thereon.

By way of another nonlimiting example, the ECD models of the present disclosure may be applied to drilling fluids (e.g., having less than 5% of the solids being cuttings) to quantify the effect of rotation of a drill string on ECD. Accordingly, some embodiments may involve changing the rotational speed of a drill string based on ECD models of the present disclosure to change the ECD of a drilling fluid. In cleaning operations, for example, the drilling fluid may be preferably displaced by a fluid (e.g., a spacer fluid, a cement slurry, or a completion fluid) before a cementing or completion operation where the rotation of the tubular may cause the drilling fluid to flow more readily and reduce the amount of residual drilling fluid in the wellbore when displaced in a subsequent cementing or cleaning operation. Reducing the residual drilling fluid may increase the efficacy of subsequent cementing or cleaning operations because the residual drilling fluid can physically and chemically interact adversely with the cement slurry, cement setting processes, and completion fluids.

By way of yet another nonlimiting example, when drilling a wellbore penetrating a subterranean formation, a drilling fluid is circulated through the wellbore, and the drill string is typically rotated in the wellbore. In such instances, the ECD downhole may be managed to mitigate the ECD becoming too high and the drill pipe becoming stuck in the wellbore. Generally, the ECD may increase when the drilling fluid is stagnant and (1) weighting agents settle (or sag), (2) gels increase viscosity, or (3) both within the drilling fluid. The ECD model may be used alone or in conjunction with other calculations to mitigate or manage the increased density. For example, gels may be broken by rotating the drill string.

By way of another nonlimiting example, drill pipe rotation per the ECD model described herein may be used in combination with reaming or scrapping operations to enhance the amount of solids removed from the surfaces downhole.

By way of yet another nonlimiting example, the ECD models described herein may be used in managing the drilling fluid viscosity to enhance the removal of drill cuttings from the wellbore during drilling operations or subsequent cleaning operations.

By way of another nonlimiting example, the ECD model may be used to more accurately predict pump pressures by accounting for frictional losses in the tubular and in the annulus together due to fluid flow.

The processor may be a portion of computer hardware used to implement the various illustrative blocks, modules, elements, components, methods, and algorithms described herein. The processor may be configured to execute one or more sequences of instructions, programming stances, or code stored on a non-transitory, computer-readable medium. The processor can be, for example, a general purpose microprocessor, a microcontroller, a digital signal processor, an application specific integrated circuit, a field programmable gate array, a programmable logic device, a controller, a state machine, a gated logic, discrete hardware components, an artificial neural network, or any like suitable entity that can perform calculations or other manipulations of data. In some embodiments, computer hardware can further include elements such as, for example, a memory (e.g., random access memory (RAM), flash memory, read only memory (ROM), programmable read only memory (PROM), erasable programmable read only memory (EPROM)), registers, hard disks, removable disks, CD-ROMS, DVDs, or any other like suitable storage device or medium.

Executable sequences described herein can be implemented with one or more sequences of code contained in a memory. In some embodiments, such code can be read into the memory from another machine-readable medium. Execution of the sequences of instructions contained in the memory can cause a processor to perform the process steps described herein. One or more processors in a multi-processing arrangement can also be employed to execute instruction sequences in the memory. In addition, hard-wired circuitry can be used in place of or in combination with software instructions to implement various embodiments described herein. Thus, the present embodiments are not limited to any specific combination of hardware and/or software.

As used herein, a machine-readable medium will refer to any medium that directly or indirectly provides instructions to the processor for execution. A machine-readable medium can take on many forms including, for example, non-volatile media, volatile media, and transmission media. Non-volatile media can include, for example, optical and magnetic disks. Volatile media can include, for example, dynamic memory. Transmission media can include, for example, coaxial cables, wire, fiber optics, and wires that form a bus. Common forms of machine-readable media can include, for example, floppy disks, flexible disks, hard disks, magnetic tapes, other like magnetic media, CD-ROMs, DVDs, other like optical media, punch cards, paper tapes and like physical media with patterned holes, RAM, ROM, PROM, EPROM and flash EPROM.

Embodiments described herein include, but are not limited to, Embodiment A, Embodiment B, Embodiment C, and Embodiment D.

Embodiment A is a method comprising: rotating a rotating tubular in a stationary conduit while flowing a fluid through an annulus between the rotating tubular and the stationary conduit; calculating an equivalent circulating density ("ECD") of the fluid where a calculated viscosity of the fluid is based on an ECD model $\mu_{eff}=f(\dot{\gamma}_{eff})*h(Re)$, wherein $\mu_{eff}$ is the viscosity of the fluid, $\dot{\gamma}_{eff}$ is an effective shear rate of the fluid, and Re is a Reynold's number for the fluid for the rotational speed of the rotating tubular; and changing at least one selected from the group consisting of: a rotational speed of the rotating tubular, a flow rate of the fluid, a yield stress of the wellbore fluid, a shear-dependent viscosity of the wellbore fluid, a formulation of the wellbore fluid, and any combination thereof to maintain or change the ECD of the fluid. Embodiment A may optionally include one or more of the following: Element 1: wherein the ECD model is $\mu_{eff}=f(\dot{\gamma}_{eff})$ when $Re<Re_{crit}$ and $$\mu_{eff} = f(\dot{\gamma}_{eff})\left[1+\alpha\left[\left(\frac{Re}{Re_{crit}}\right)^{\beta}-1\right]\right]$$

when $Re \geq Re_{crit}$, wherein $Re_{crit}$ is a critical Reynold's number for the fluid, and $\alpha$ and $\beta$ are experimentally determined factors for the fluid; Element 2: Element 1 and wherein $f(\dot{\gamma}_{eff})$ is calculated based on assuming the fluid is one selected from the group consisting of: a Power-law fluid, a Bingham plastic fluid, a Herschel-Bulkley fluid, a generalized Herschel-Bulkley fluid, and a Casson fluid; Element 3: the method further comprising maintain the ECD of the fluid between a fracture gradient and a pore-pressure gradient of a formation that the rotating tubular and the stationary conduit are extending into; Element 4: wherein the fluid is a cement slurry, the rotating tubular is a tubular, and the stationary tubular is a casing; Element 5: wherein the fluid is a cement slurry, the rotating tubular is a casing, and the stationary tubular is a wellbore; Element 6: wherein the fluid is a drilling fluid, the rotating tubular is a drill string, and the stationary tubular is a wellbore or a casing. Exemplary combinations may include, but are not limited to, one of Elements 4-6 in combination with Element 1 and optionally Element 2; one of Elements 4-6 in combination with Element 3; and Element 3 in combination with Element 1 and optionally Element 2 and optionally in further combination with one of Elements 4-6.

Embodiment B is a method comprising: modeling a wellbore operation that comprises: rotating a rotating tubular in a stationary conduit while flowing a fluid through an annulus between the rotating tubular and the stationary conduit; calculating an equivalent circulating density ("ECD") of the fluid where a calculated viscosity of the fluid is based on an ECD model $\mu_{eff}=f(\dot{\gamma}_{eff})*h(Re)$, wherein $\mu_{eff}$ is the viscosity of the fluid, $\dot{\gamma}_{eff}$ is an effective shear rate of the fluid, and Re is a Reynold's number for the fluid for the rotational speed of the rotating tubular; and determining wellbore operation parameters that maintain the ECD of the fluid between a fracture gradient and a pore-pressure gradient of a formation that the rotating tubular and the stationary conduit are extending into. Embodiment B may optionally include one or more of the following: Element 1; Element 2; Element 3; Element 4; Element 5; Element 6; and Element 7: wherein the wellbore operation parameters comprise at least one selected from the group consisting of: the rotational speed of the rotating tubular, a flow rate of the wellbore fluid, a yield stress of the wellbore fluid, a shear-dependent viscosity of the wellbore fluid, a formulation of the wellbore fluid, and any combination thereof to maintain or change the ECD of the wellbore fluid. Exemplary combinations may include, but are not limited to, one of Elements 4-6 in combination with Element 1 and optionally Element 2; one of Elements 4-6 in combination with Element 3; and Element 3 in combination with Element 1 and optionally Element 2 and optionally in further combination with one of Elements 4-6; Element 7 in combination with any of the foregoing; Element 7 in combination with one of Elements 4-6; Element 7 in combination with Element 1 and optionally Element 2; and Element 7 in combination with Element 3.

Embodiment C is a system comprising: an annulus between a rotating tubular and a stationary conduit; a wellbore fluid flowing through the annulus; a non-transitory computer-readable medium coupled to a motor coupled to the rotating tubular to receive a rotational speed of the rotating tubular and encoded with instructions that, when executed, perform operations comprising: calculating an equivalent circulating density ("ECD") of the wellbore fluid where a calculated viscosity of the wellbore fluid is based on an ECD model $\mu_{eff}=f(\dot{\gamma}_{eff})*h(Re)$, wherein $\mu_{eff}$ is the viscosity of the wellbore fluid, $\gamma_{eff}$ is an effective shear rate of the wellbore fluid, and Re is a Reynold's number for the wellbore fluid for the rotational speed of the rotating tubular. Embodiment C may optionally include one or more of the following: Element 1; Element 2; Element 3; Element 4; Element 5; Element 6; and Element 8: wherein, when executed, the instructions perform operations further comprising: changing at least one selected from the group consisting of: the rotational speed of the rotating tubular, a flow rate of the wellbore fluid, a yield stress of the wellbore fluid, a shear-dependent viscosity of the wellbore fluid, a formulation of the wellbore fluid, and any combination thereof to maintain or change the ECD of the wellbore fluid. Exemplary combinations may include, but are not limited to, one of Elements 4-6 in combination with Element 1 and optionally Element 2; one of Elements 4-6 in combination with Element 3; and Element 3 in combination with Element 1 and optionally Element 2 and optionally in further combination with one of Elements 4-6; Element 8 in combination with any of the foregoing; Element 8 in combination with one of Elements 4-6; Element 8 in combination with Element 1 and optionally Element 2; and Element 8 in combination with Element 3.

Embodiment D is a non-transitory computer-readable medium encoded with instructions that, when executed, perform operations comprising: rotating a rotating tubular in a stationary conduit while flowing a wellbore fluid through an annulus between the rotating tubular and the stationary conduit; calculating an equivalent circulating density ("ECD") of the wellbore fluid where a calculated viscosity of the wellbore fluid is based on an ECD model that accounts for shear thinning and Taylor instability of the wellbore fluid. Embodiment D may optionally include one or more of the following: Element 1; Element 2; Element 3; Element 4; Element 5; Element 6; and Element 9: wherein the operations further comprise: changing at least one selected from the group consisting of: a rotational speed of the rotating tubular, a flow rate of the wellbore fluid, a yield stress of the wellbore fluid, a shear-dependent viscosity of the wellbore fluid, a formulation of the wellbore fluid, and any combination thereof to maintain or change the ECD of the wellbore fluid. Exemplary combinations may include, but are not limited to, one of Elements 4-6 in combination with Element 1 and optionally Element 2; one of Elements 4-6 in combination with Element 3; and Element 3 in combination with Element 1 and optionally Element 2 and optionally in further combination with one of Elements 4-6; Element 9 in combination with any of the foregoing; Element 9 in combination with one of Elements 4-6; Element 9 in combination with Element 1 and optionally Element 2; and Element 9 in combination with Element 3.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the embodiments of the present invention. At the very least, and not as an attempt to limit the application of the doctrine of equivalents to the scope of the claim, each numerical parameter should at least be construed in light of the number of reported significant digits and by applying ordinary rounding techniques.

One or more illustrative embodiments incorporating the invention embodiments disclosed herein are presented herein. Not all features of a physical implementation are described or shown in this application for the sake of clarity. It is understood that in the development of a physical embodiment incorporating the embodiments of the present invention, numerous implementation-specific decisions must be made to achieve the developer's goals, such as compliance with system-related, business-related, government-related and other constraints, which vary by implementation and from time to time. While a developer's efforts might be time-consuming, such efforts would be, nevertheless, a routine undertaking for those of ordinary skill in the art and having benefit of this disclosure.

While compositions and methods are described herein in terms of "comprising" various components or steps, the compositions and methods can also "consist essentially of" or "consist of" the various components and steps.

To facilitate a better understanding of the embodiments of the present invention, the following examples of preferred or representative embodiments are given. In no way should the following examples be read to limit, or to define, the scope of the invention.

EXAMPLES

Example 1

After the ECD was measured during a cementing operation in the field, the ECD was modeled using (1) a traditional model that does not account for shear thinning or Taylor instability and (2) an ECD model described herein. In this model, the downhole configuration was a tubular being the rotating tubular and a casing being the stationary conduit. The following values were used in the two models, where applicable, for the cement slurry properties, wellbore configuration, and cementing operation parameters: 11.52 pounds per gallon ("ppg") fluid density; 5.875-inch tubular outer diameter; 8.5-inch casing inner diameter; axial flow rate 560 gallons per minute (gpm); and $\alpha=0.024$ and $\beta=1$ (for the ECD model Equations 5). For both the traditional and ECD models, the cement slurry was considered a Herschel-Bulkley fluid such that Equation 6 was used to calculate the viscosity where yield stress ($\tau_0$)=11.8 lb/100 ft$^2$, consistency index (k)=0.33, and flow index (n)=0.82.

$$\mu=f(\dot{\gamma})=(\tau_0+k\dot{\gamma}^n)/\dot{\gamma} \qquad \text{Equation 6}$$

Figure 2:
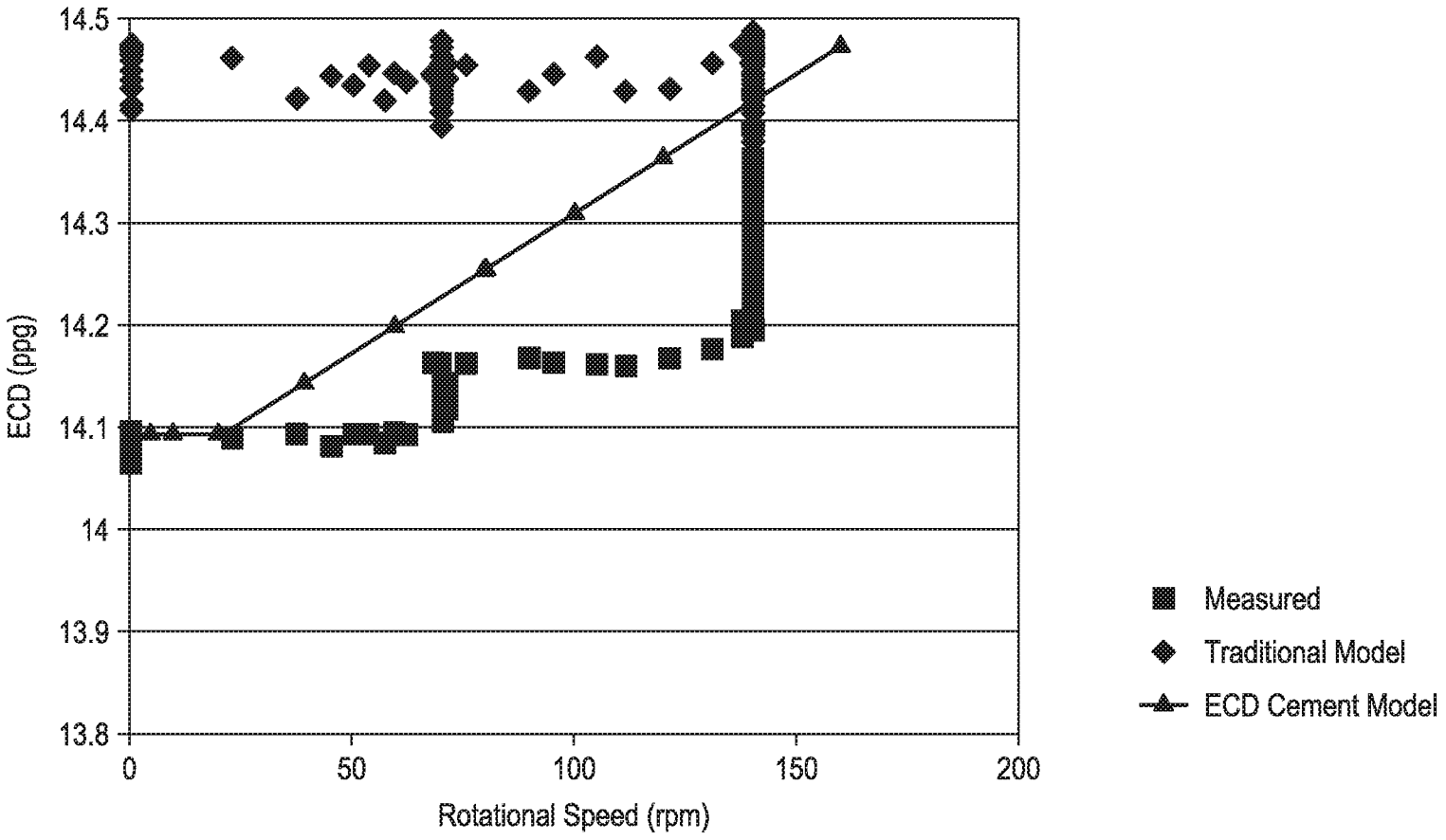
FIG. 2 is a plot of the measured ECD, the calculated ECD per the traditional model, and the calculated ECD per the ECD model as a function of the rotational speed of the tubular.

FIG. 2 is a plot of the measured ECD, the calculated ECD per the traditional model, and the calculated ECD per the ECD model as a function of the rotational speed of the rotating tubular. As the rotational speed increases from no rotation to about 140 rpm, the calculated ECD per the ECD model has a steady upward slope from 14.1 ppg to 14.4 ppg, while the calculated ECD per the traditional model is constant at about 14.45 ppg. The measured ECD increases from about 14.1 ppg to about 14.4 ppg in a step-wise manner. As illustrated, the calculated ECD per the ECD model more closely reflects the actual ECD.

Example 2

The ECD was modeled using an ECD model described herein where the cement slurry was considered a Herschel-Bulkley fluid such that Equation 6 was used to calculate the viscosity where $\tau_0$=11.88 lb/100 ft$^2$, k=0.33, and n=0.82. In this model, the downhole configuration was a casing being the rotating tubular and the wellbore being the stationary conduit. The cement slurry properties, wellbore configuration, and cementing operation parameters were: 11.52 ppg fluid density; 10-inch casing outer diameter; 13-inch wellbore inner diameter; variable axial flow rate; and $\alpha=0.024$ and $\beta=1$.

Figure 3:
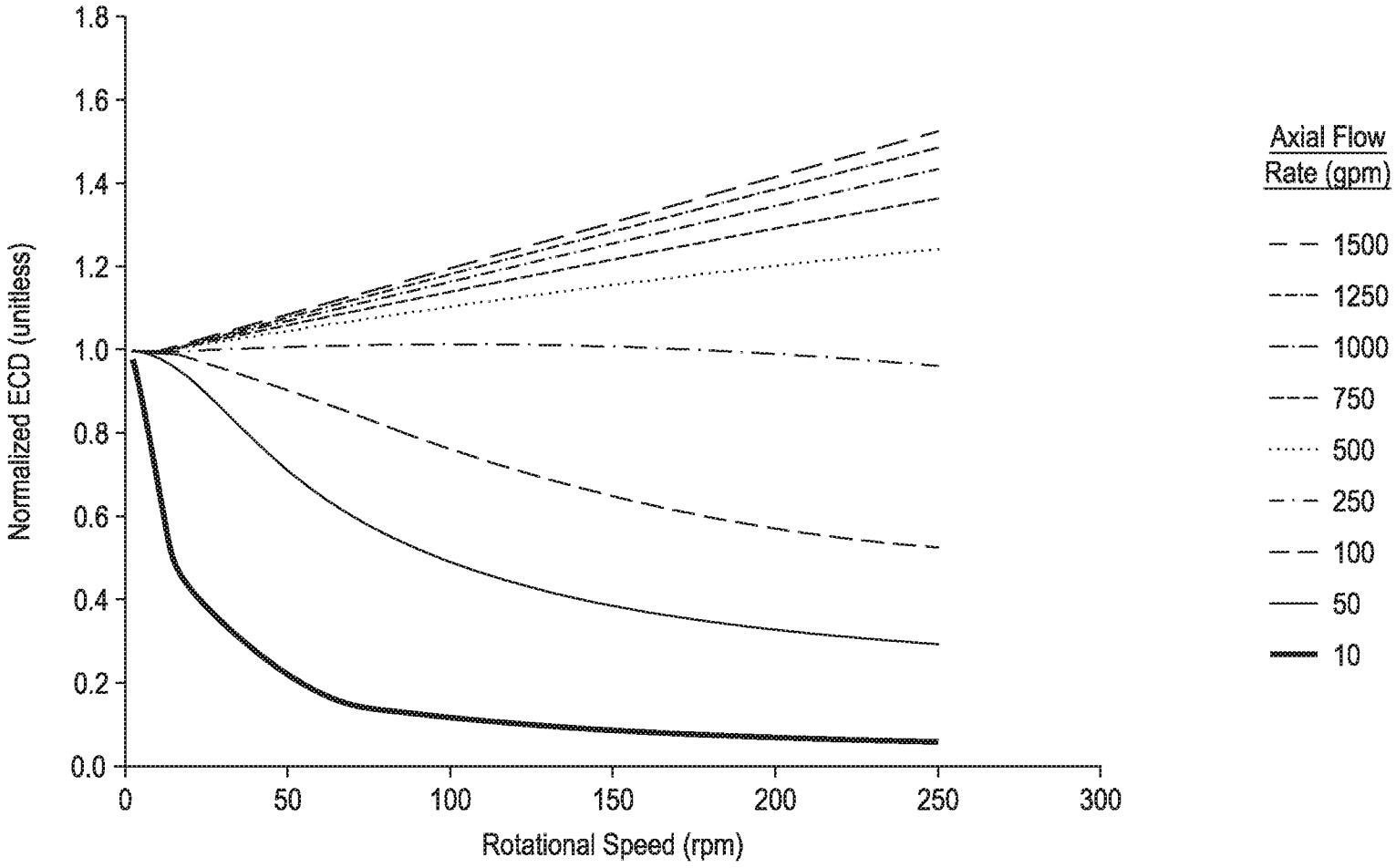
FIG. 3 illustrates plots normalized ECD for a fluid as a function of tubular rotational speed for different axial flow rates as calculated with an ECD model of the present disclosure.

The normalized ECD (unitless) for a cement slurry was modelled as a function of different tubular rotational speeds for different axial flow rates and is presented in FIG. 3. The normalized ECD is calculated as the modeled ECD for a given tubular rotational speed divided by the ECD at no rotational speed. By plotting the ECD as a normalized ECD, the increases and decreases of ECD are more clearly illustrated. For example, at an axial flow rate of 10 gpm, the shear thinning is the dominate effect and the ECD decreases with increasing rotational speed. By contrast, at an axial flow rate of 500 gpm or greater, the Taylor instability causes the ECD to increase with increasing rotational speed. Interesting, at about 250 gpm axial flow rate, the dominate effect changes where Taylor instability seems to increase the ECD until about 100 rpm and then shear thinning become more prominent and the ECD begins to decrease with increasing rotational speed. This illustrates that when the rheology of the cement slurry is known, the ECD can be adjusted by changing cement operation parameter like tubular rotational speed and axial flow rate.

Example 3

The ECD was modeled using an ECD model described herein where the cement slurry was considered a Herschel-Bulkley fluid such that Equation 6 was used to calculate the viscosity where $\tau_0$=11.88 lb/100 ft$^2$, and k=0.33. In this model, the downhole configuration was an open hole and rotating casing therein. The cement slurry properties, wellbore configuration, and cementing operation parameters were: 11.52 ppg fluid density; 10-inch casing outer diameter; 13-inch wellbore inner diameter; 5 gpm axial flow rate; $\alpha$=0.024, $\beta$=1; and n was variable. In this model, the downhole configuration was a casing being the rotating tubular and the wellbore being the stationary conduit.

Figure 4:
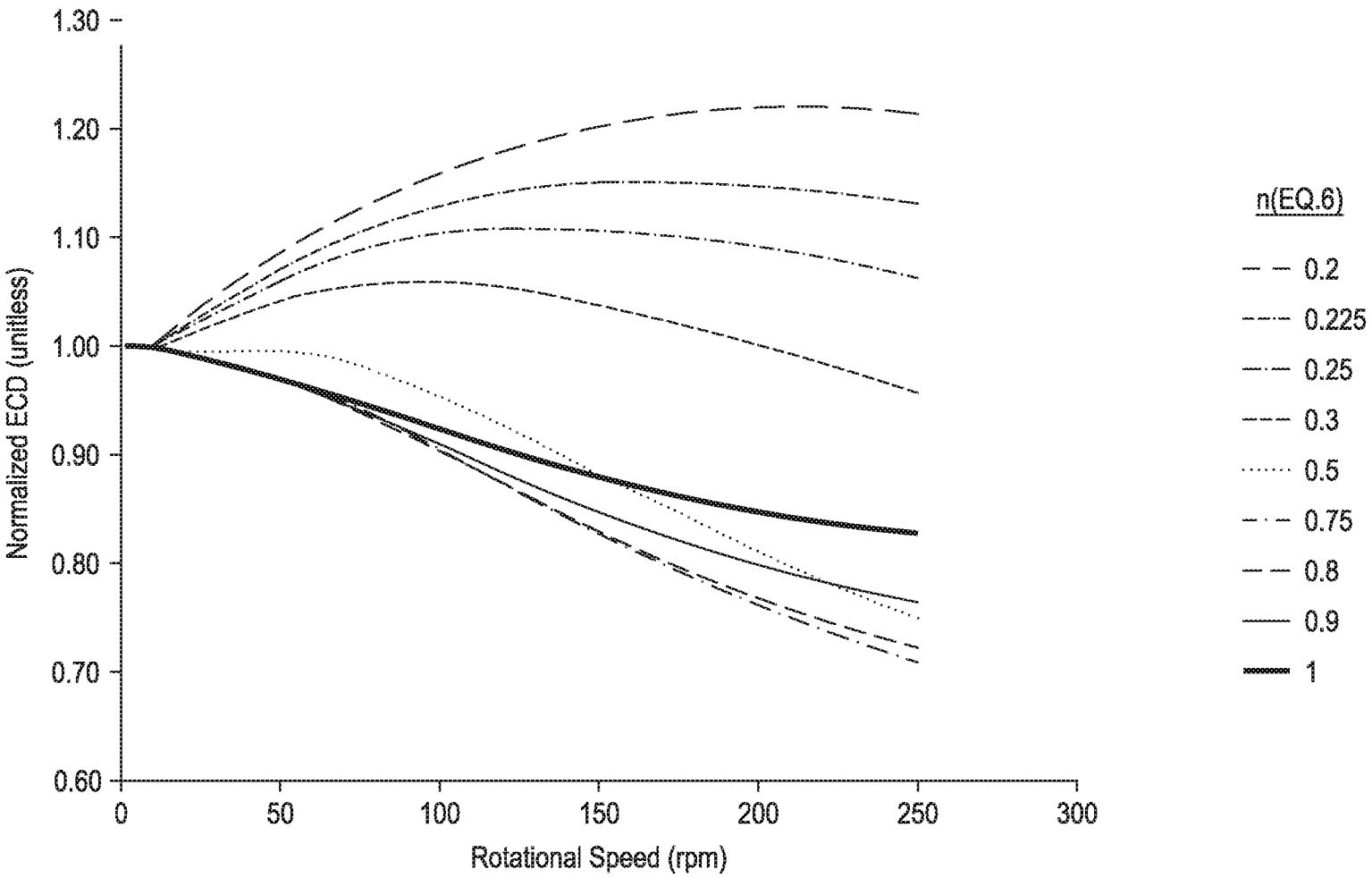
FIG. 4 illustrates plots normalized ECD for a fluid as a function of tubular rotational speed for different n values (see Equation 6) as calculated with an ECD model of the present disclosure.

The normalized ECD (unitless) for a cement slurry was modelled as a function of different tubular rotational speeds for different n values and is presented in FIG. 4. Because n is related to the rheology of the cement slurry and governs the shear thinning nature of the fluid. Lower the value of n higher the shear thinning effect. This example illustrates how changes in viscosity can be used to maintain or adjust ECD of the cement slurry. Lower n values (i.e., highly shear thinning cement slurries) appear to be dominated by Taylor instability, while for higher n values the effect of Taylor instability is subdued. Additionally, at intermediate n values (e.g., 0.3), the Taylor instability appears to be the dominate effect at lower rotational speeds and then shear thinning dominates at higher rotational speeds to reduce the ECD. This example illustrates that the rheology of the cement slurry can be tailored or changed to achieve desired ECD values.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

The invention claimed is:

1. A method comprising:

flowing a fluid through an annulus between a rotating tubular and a stationary conduit for a wellbore operation in a wellbore;

determining a critical rotational speed of the rotating tubular, above which a formation of toroidal vortices in the fluid occurs;

calculating a viscosity of the fluid for an operating rotational speed of the rotating tubular based on an equivalent circulating density ("ECD") model, wherein the ECD model is based, at least in part, on an effective shear rate of the fluid, wherein the ECD model is based, at least in part, on a ratio of Reynold's numbers at the operating rotational speed and the critical rotational speed when the rotational speed of the rotating tubular is greater than or equal to the critical rotational speed;

calculating an ECD of the fluid based on the viscosity of the fluid; and based on the ECD of the fluid, adjusting one or more operation parameters for the wellbore operation to control the ECD of the fluid.

2. The method of claim 1, wherein the ECD model is $\mu_{eff}=f(\dot{\gamma}_{eff})$ when $Re<Re_{crit}$ and $$\mu_{eff} = f(\dot{\gamma}_{eff})\left[1 + \alpha\left[\left(\frac{Re}{Re_{crit}}\right)^{\beta} - 1\right]\right]$$

when $Re \geq Re_{crit}$, wherein $\mu_{eff}$ is the viscosity of the fluid, $\dot{\gamma}_{eff}$ is the effective shear rate of the fluid, Re is the Reynold's number for the fluid at the operating rotational speed of the rotating tubular, $Re_{crit}$ is a critical Reynold's number for the fluid at the critical rotational speed, and $\alpha$ and $\beta$ are experimentally determined factors for the fluid.

3. The method of claim 2, wherein $f(\dot{\gamma}_{eff})$ is calculated based on assuming the fluid is one of a Power-law fluid, a Bingham plastic fluid, a Herschel-Bulkley fluid, a generalized Herschel-Bulkley fluid, and a Casson fluid.

4. The method of claim 1, wherein adjusting the one or more operation parameters for the wellbore operation to control the ECD of the fluid comprises maintaining the ECD of the fluid between a fracture gradient and a pore-pressure gradient of a formation surrounding the wellbore.

5. The method of claim 1, wherein the fluid is a cement slurry and the stationary conduit is a casing.

6. The method of claim 1, wherein the fluid is a drilling fluid, the rotating tubular is a drill string, and the stationary conduit is one of the wellbore and a casing positioned in the wellbore.

7. A method comprising:

modeling a wellbore operation that comprises:

rotating a tubular in a stationary conduit of a wellbore at an operating rotational speed;

flowing a fluid through an annulus between the rotating tubular and the stationary conduit;

calculating a viscosity of the fluid for the operating rotational speed of the rotating tubular based on an equivalent circulating density ("ECD") model, wherein the ECD model is based, at least in part, on an effective shear rate of the fluid, wherein, at operating rotational speeds less than a critical rotational speed, an operating Reynold's number for the fluid is less than a critical Reynold's number for the fluid and wherein, at operating rotational speeds greater than or equal to the critical rotational speed, the ECD model is based, at least in part, on a ratio of Reynold's numbers at the operating rotational speed and the critical rotational speed of the rotating tubular;

calculating an equivalent circulating density ("ECD") of the fluid based on the viscosity of the fluid; and determining, using the ECD model, wellbore operation parameters that maintain the ECD of the fluid between a fracture gradient and a pore-pressure gradient of a formation.

8. The method of claim 7, wherein the wellbore operation parameters comprise at least one of the operating rotational speed of the rotating tubular, a flow rate of the fluid, a yield stress of the fluid, the viscosity of the fluid, and a formulation of the fluid.

9. The method of claim 7, wherein the ECD model is $\mu_{eff}=f(\dot{\gamma}_{eff})$ when $Re<Re_{crit}$ and $$\mu_{eff} = f(\dot{\gamma}_{eff})\left[1+\alpha\left[\left(\frac{Re}{Re_{crit}}\right)^{\beta}-1\right]\right]$$

when $Re \geq Re_{crit}$, wherein $\mu_{eff}$ is the viscosity of the fluid, $\dot{\gamma}_{eff}$ is the effective shear rate of the fluid, Re is the operating Reynold's number for the fluid at the operating rotational speed of the rotating tubular, $Re_{crit}$ is the critical Reynold's number for the fluid, and $\alpha$ and $\beta$ are experimentally determined factors for the fluid.

10. The method of claim 9, wherein $f(\dot{\gamma}_{eff})$ is calculated based on assuming the fluid is one of a Power-law fluid, a Bingham plastic fluid, a Herschel-Bulkley fluid, a generalized Herschel-Bulkley fluid, and a Casson fluid.

11. The method of claim 7, wherein the fluid is a cement slurry.

12. The method of claim 7, wherein the stationary conduit is one of a casing positioned in the wellbore and the wellbore.

13. The method of claim 7, wherein the fluid is a drilling fluid and the rotating tubular is a drill string.

14. A system comprising:

a rotating tubular positioned within a stationary conduit of a wellbore and forming an annulus between the rotating tubular and the stationary conduit;

a processor; and a non-transitory computer-readable medium having program code executable by the processor to cause the processor to:

calculate an equivalent circulating density ("ECD") of a fluid flowing through the annulus as the rotating tubular rotates at an operating rotational speed, wherein the ECD is calculated based, at least in part, on an effective shear rate of the fluid, on an operating Reynold's number of the fluid at the operating rotational speed, on a critical Reynold's number of the fluid at a critical rotational speed of the rotating tubular, wherein the critical Reynold's number of the fluid is the operating Reynold's number of the fluid when the operating rotational speed is equal to the critical rotational speed, and wherein, at operating rotational speeds greater than or equal to the critical rotational speed, the ECD is calculated based, at least in part, on a ratio of the Reynold's numbers at the operating rotational speed and the critical rotational speed.

15. The system of claim 14, wherein the program code comprises program code executable by the processor to cause the processor to:

determine one or more wellbore operation parameters that maintain the ECD of the fluid between a fracture gradient and a pore-pressure gradient of a formation surrounding the wellbore.

16. The system of claim 14, wherein the ECD model is $\mu_{eff}=f(\dot{\gamma}_{eff})$ when $Re<Re_{crit}$ and $$\mu_{eff} = f(\dot{\gamma}_{eff})\left[1+\alpha\left[\left(\frac{Re}{Re_{crit}}\right)^{\beta}-1\right]\right]$$

when $Re \geq Re_{crit}$, wherein $\mu_{eff}$ is a viscosity of the fluid, $\dot{\gamma}_{eff}$ is the effective shear rate of the fluid, Re is the operating Reynold's number for the fluid at the operating rotational speed of the rotating tubular, $Re_{crit}$ is the critical Reynold's number for the wellbore fluid, and $\alpha$ and $\beta$ are experimentally determined factors for the wellbore fluid.

17. A non-transitory computer-readable medium encoded with instructions that, when executed, cause a processor to:

determine, for a fluid flowing through an annulus formed between an inner tubular rotating at an operating rotational speed and a stationary conduit in a wellbore, an operating Reynold's number of the fluid;

determine, at an operating speed greater than or equal to a critical rotational speed of the rotating inner tubular, a critical Reynold's number of the fluid;

determine whether the operating Reynold's number of the fluid is less than the critical Reynold's number of the fluid, wherein, at operating rotational speeds greater than or equal to the critical rotational speed, the operating Reynold's number of the fluid is greater than the critical Reynold's number;

calculate, based on the determination, a viscosity of the fluid at the operating rotational speed, wherein the viscosity of the fluid is based, at least in part, on an effective shear rate of the fluid, wherein, at operating rotational speeds greater than or equal to the critical rotational speed, the viscosity of the fluid is based, at least in part, on a ratio of Reynold's numbers at the operating rotational speed and the critical rotational speed; and calculate an equivalent circulating density ("ECD") of the fluid based on the viscosity of the fluid.

18. The non-transitory computer-readable medium of claim 17, wherein the instructions, when executed, cause the processor to change at least one of the operating rotational speed of the inner tubular, a flow rate of the fluid, the viscosity of the fluid, and a formulation of the fluid.

19. The method of claim 1, wherein adjusting the one or more operation parameters for the wellbore operation comprises adjusting at least one of the operating rotational speed of the rotating tubular, a flow rate of the fluid, and the viscosity of the fluid.

20. The system of claim 15, wherein the one or more wellbore operation parameters comprise at least one of the operating rotational speed of the rotating tubular, a flow rate of the fluid, a yield stress of the fluid, a viscosity of the fluid, and a formulation of the fluid.

* * * * *